United States Patent [19]

Johnson et al.

[11] Patent Number: 4,646,978

[45] Date of Patent: Mar. 3, 1987

[54] METHOD FOR SORTING RADIOACTIVE WASTE

[75] Inventors: Alfred N. Johnson, Voorhees; Anthony J. Prisco, Beverly, both of N.J.

[73] Assignee: Westinghouse Electric Corp., Pittsburgh, Pa.

[21] Appl. No.: 648,780

[22] Filed: Sep. 10, 1984

[51] Int. Cl.[4] ..... B02C 23/14

[52] U.S. Cl. ..... 241/24; 209/576; 209/589; 241/30

[58] Field of Search ..... 209/576, 589; 241/24, 241/30, 68, 79.1, 101.2, 101.3, 101.5

[56] References Cited

U.S. PATENT DOCUMENTS

| | | | |
|---|---|---|---|
| 2,617,526 | 11/1952 | LaPointe | 209/72 |
| 2,717,693 | 9/1955 | Holmes | 209/72 |
| 3,052,353 | 9/1962 | Pritchett | 209/111.5 |
| 3,075,641 | 1/1963 | Hutter et al. | 209/74 |
| 3,259,744 | 7/1966 | Gorecki et al. | 250/71.5 |
| 3,768,645 | 10/1973 | Conway et al. | 209/111.5 |
| 4,194,634 | 3/1980 | Kelly | 209/589 |
| 4,275,298 | 6/1981 | Wykes et al. | 250/255 |
| 4,365,719 | 12/1982 | Kelly | 209/589 |

*Primary Examiner*—Howard N. Goldberg
*Assistant Examiner*—Timothy V. Eley
*Attorney, Agent, or Firm*—L. A. DePaul

[57] ABSTRACT

This invention relates to a method for examining dry material, components of which may have a low level of radioactivity, to sort the radioactive components from the nonradioactive components.

7 Claims, 1 Drawing Figure

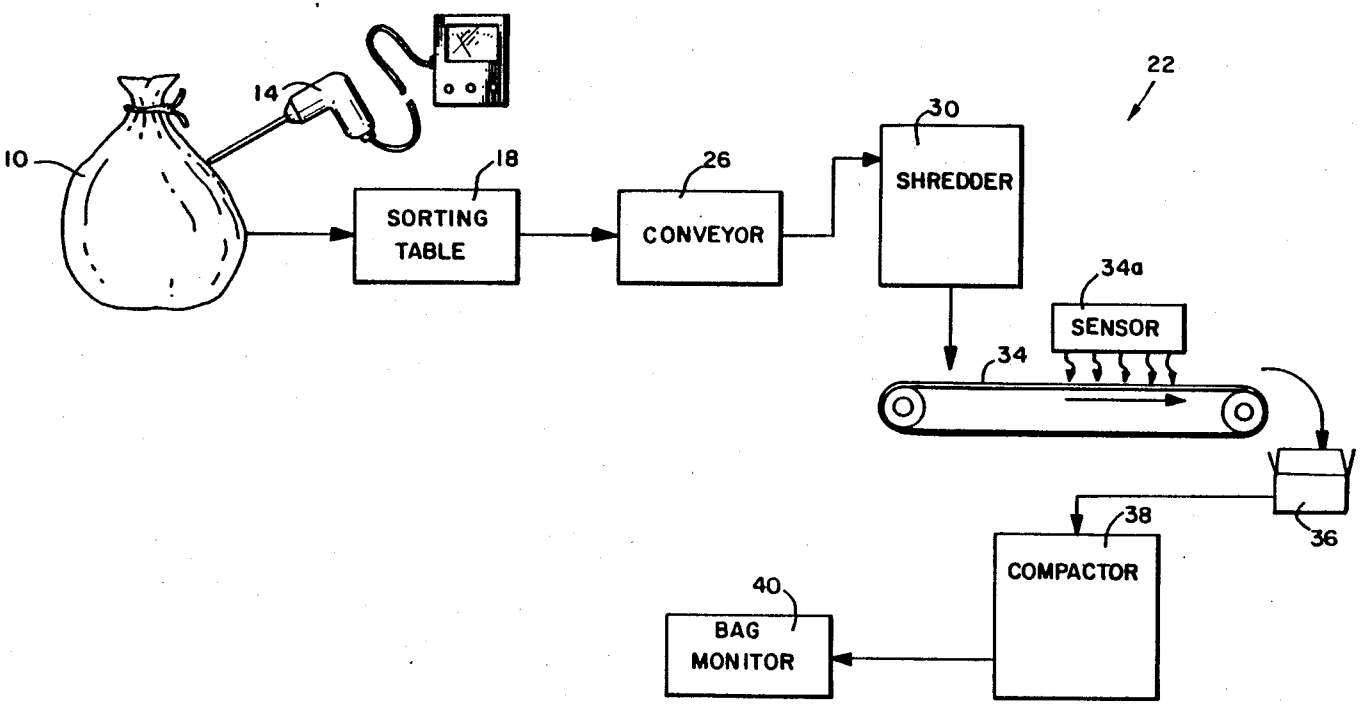
22
10
14
SORTING TABLE
18
CONVEYOR
26
SHREDDER
30
34
SENSOR
34a
36
COMPACTOR
38
BAG MONITOR
40

METHOD FOR SORTING RADIOACTIVE WASTE

SUMMARY OF THE INVENTION

This invention relates to a method for examining dry material, components of which may have a low level of radioactivity, to sort the radioactive components from the nonradioactive components. It comprises the steps of placing of material in a first detection station where radiation above a predetermined level can be detected and then removing the components from which the radiation is emanating. The remainder of the material is then conveyed to a second detection station where means are provided for detecting radiation above a second predetermined level. The components of the material which is detected as having radiation which is a level above the second level is then removed. The remaining components are then placed in a container and the container is delivered to a third radiation detection station where radiation emanating from the container which is above a predetermined level is detected. If no radiation is detected as emanating from the container then the container and the material therein are disposed of as nonradioactive.

BACKGROUND OF THE INVENTION

This invention relates to a method for sorting radioactive waste having a low level of radioactivity and more particularly to a method which is inexpensive and efficient.

The waste presents problems due to the danger of injury to those that may come into contact with it notwithstanding the fact that only low levels of radioactivity are present. Thus, while it is generally acknowledged that exposure to low levels of radiation over long periods of time is hazardous, there is inadequate information as to what levels of radiation are safe over a long term of exposure. Typically, industry standards have set five REM per year as the maximum exposure to which a human should be subjected. A REM is a Roengten Equivalent Man, a well known measure of exposure to radiaion.

The radiation arises from the emission of alpha and beta particles as well as the emission of gamma rays. The beta particles and gamma rays present more of a hazard from external exposure than the alpha particles. This is because the alpha particles which comprise helium nuclei are charged and have a relatively high mass. Consequently, they can be stopped by a material such as a sheet of paper.

Beta particles, which are free electrons, have substantially greater penetrating power than alpha particles. Nevertheless, they can be stopped by a few millimeters of a metal such as aluminum.

Gamma rays, however, have unlimited range since they have the ability to make deep penetrations of material. They can only be minimized by a substantial thickness of a material such as lead.

As nuclear facilities tend to proliferate, the disposition of waste has become an increasing problem. This is because burial sites are at a premium and because huge quantities of waste are generated by these facilities. Waste which is highly active, such as spent nuclear fuel or the like, is buried after being placed in shielded canisters. However, because of the difficulty of obtaining burial sites, it is worthwhile to examine waste having a low activity to remove the nonactive components. This reduces the quantity of material which must be buried. Typically, waste having low activity includes paper, fabrics, boots, clothing, tools and various miscellany which can normally be expected to be used and disposed of in the operation of a nuclear facility. The waste may be collected in bags at the facility. It may include items that emit alpha and beta particles as well as gamma rays. Other items may not be radioactive. Occasionally, an effort may be made to sort items of high value such as tools and the like. However, this effort is usually discouraged because of the risk of personnel of radiation contamination.

As a result, large quantities of waste are generated for burial because they are believed to have low levels of radioactivity notwithstanding the fact that they have no radioactive content or that the materials which are radioactive can be readily segregated from the nonactive waste. Consequently, much more material is being buried than is necessary.

The present invention relates to a method for segregating the components of radioactive waste having an activity above predetermined levels from the remainder of the waste. The method results in a substantial reduction in the volume of radioactively contaminated waste that need be buried.

The method is operable on an almost continuous basis. Further, it relys on detectors which generate alarms when radioactivity above predetermined levels is detected. It is especially advantageous since it can be operated by persons of relatively low skill.

Further, in the event of mechanical failure, those portions of the system which are operative can continue to operate while replacement parts are obtained for those portions which have failed.

BRIEF DESCRIPTION OF THE DRAWINGS

FIG. 1 is a schematic drawing showing the steps which comprise the method for sorting radioactive waste in accordance with a presently preferred form of the invention.

DETAILED DESCRIPTION OF THE PREFERRED EMBODIMENT

Preferably, waste from various parts of a power plant or other facility is collected, placed in suitable containers such as plastic bags and surveyed for radioactivity. The bags may be small enough so that when they are filled they can be readily handled by maintenance people.

The filled bags are delivered to a station where they are examined to determine their radioactivity. Bags that display a predetermined level of activity may be disposed of as radioactive.

The remaining bags are delivered to an inspection station where their contents are emptied so that their components can be inspected by radiation detectors. During this interval items which are considered to be of value such as tools, laboratory equipment, clothing and the like can be separated from the other waste and saved.

At an intermediate portion of the method the waste is shredded to a relatively small size so that radiation emanating from it can be readily detected as it passes under radiation detectors.

Finally, the shredded material is collected in suitable containers such as bags or boxes and compacted. The compacted material is transferred to a last detector for final examination. If no radiation above a predetermined level is detected then the container can be disposed of as clean waste. On the other hand, if radiation above the predetermined level is detected then the container is disposed of as radioactive waste.

Since most of the waste which is collected at nuclear facilities is not radioactive, the ability to segregate the nonradioactive components from the radioactive components results in a significant and dramatic reduction in the volume of waste which must be treated as radioactive.

In view of the fact that disposal sites for radioactive waste are at a premium, the ability to reduce the volume of radioactive waste significantly makes an important contribution to the nuclear power plant industry.

Referring now to the drawing in detail, a bag 10 is illustrated. The bag may be made of any convenient material such as that which is readily available commercially as trash bags. Typically, such bags should be small enough to be easily handled when they are full. They are placed in receptacles at various locations in the nuclear facility so that waste which may have a low level of radioactivity can be placed in them by the plant personnel. The waste may come from various parts of a power plant such as the offices, shops, laboratories and work areas. The waste may comprise wrappers, papers, tools, shoes, clothing, metal parts, fittings and the like.

After being collected, a filled bag 10 is given a preliminary examination for radiation emission at a suitable station 14. The examination may be conducted by suitable dose rate meters of a type well known. If the radiation exposure hazard from a bag is greater than a predetermined level such as two milliroentgens per hour, the bag is considered to be a radiologic hazard to be disposed of without further action along with other hazardous substances.

If the bag 10 does not cause the dose rate meter to exceed the predetermined level, it is considered to have a low enough level of radioactivity to have its contents examined. In this regard it is removed to a first radiation detection station 18. The first station may be a suitably shielded sorting table of the type which includes radiation detectors and which is constructed to minimize the radiation hazard to which operating personnel might be exposed.

A suitable table may take the form of the Sorting Table which is disclosed in co-pending application Ser. No. 648,779, filed Sept. 10, 1984 entitled ENCLOSURE FOR SORTING RADIOACTIVE MATERIAL which was executed on Aug. 24, 1984, by Anthony J. Prisco and Alfred N. Johnson. At the sorting table the operating personnel open the bag and the contents of the bag are individually examined for beta particle contamination. A suitable device for measuring beta contamination is a gas proportional detector. Gas proportional detectors are well known in the art and need not be described in detail. Preferably, the gas proportional detector is arranged to detect surface contamination levels in beta particle disintegrations per minute per 100 square centimeters. Disintegrations per minute per 100 square centimeters is the standard unit of measurement for surface contamination.

Should an item which was contained in the bag exhibit beta surface contamination in excess of a predetermined level, an alarm is energized. The operator can remove the item from detection station 18 for treatment as radioactive waste.

Those components of the waste which do not energize the alarm are then transferred to a second radiation detection station 22 by the operating personnel.

The second radiation detector station 22 may comprise a suitable conveyor 26 which delivers the articles of waste from the second radiation detection station 18 to a shredding device 30. The shredder 30 shreds the waste so that the size of the items contained is reduced to a relatively small uniform size. After passing through the shredder 30, the shredded waste is spread to a substantially uniform thickness and moves on a conveyor 34 past suitable beta particle and gamma ray detectors 34*a*.

The beta particle detectors are typically gas proportional detectors of a type which are well known in the art. They may be arranged to energize an alarm when they detect surface contamination levels in excess of predetermined levels. This is duplicative to some extent of the detection level which is available at station 18. However, it tends to serve as a reinforcement of the reliability of the first detector.

The gamma ray detectors may comprise scintillation detectors of a type which is well known in the art. The scintillation detectors are arranged so that they energize an alarm if surface contamination in excess of predetermined gamma contamination levels are detected.

Since beta particles have a low penetrating power, the waste is overturned and redistributed during the curse of the examination so that beta particles which are emitted from hidden surfaces can also be second radiation detectors.

A suitable device for conveying the waste to a shredder, shredding and overturning the material as it is being examined is disclosed in co-pending application Ser. No. 648,833 filed Sept. 10, 1984 entitled CONVEYOR FOR SORTING RADIOACTIVE WASTE AND METHOD OF USING THE SAME which was executed by Anthony J. Prisco and Alfred N. Johnson on Aug. 24, 1984.

If any components of the waste which is being examined exhibits activity in excess of predetermined surface contamination levels, the alarm is energized to alert the operator to remove the contaminated components from the conveyor for disposal as radiologically active waste.

The components which do not energize the alarm are permitted to continue along the conveyor 34 where they are dispensed into a suitable container 36.

Preferably, the container 36 is comprised of an inexpensive light weight material which can be readily manufactured and handled. Successful results have been achieved with plastic trash bags and ordinary cardboard boxes. The bags and boxes are usually strong enough to support the shredded waste. Because of the nature of beta particles, to the extent that such particles remain in the waste, they are stopped by the container 36. However, due to the fact that the gamma rays can pass through the containers, they are checked again for gamma radiation.

In view of the low likelihood that gamma radiation is contained in the surviving waste, it is worthwhile to compact the material into the container. This greatly increases its density without increasing its volume. Consequently a large mass of material can be examined for gamma ray emission at one time. In this regard, a suitable compactor 38 is provided. The compactor can be of any size or model that is commercially available in the art. A suitable compactor is available from Union Environmental Division of Union Corporation in Old Forge, Penn.

The container 36 of compacted waste is then delivered to a third radiation detection station 40. The third radiation detection station may comprise a detector for measuring gamma ray contamination. To this extent, it may comprise several scintillation detectors which are arranged so that they can detect gamma contamination at a predetermined level of radioactivity.

If gamma ray contamination in excess of a predetermined level is detected, the contents of the container are treated as radioactive waste and are disposed of accordingly. However, if that level of contamination is not detected, then the container can be disposed of with the ordinary non-radioactive waste which is generated by the nonradiologically controlled parts of the facility.

A typical device which can be used for the detection of gamma radiation emanating from a container of compacted material is disclosed in co-pending application Ser. No. 648,778 filed Sept. 10, 1984 which wass executed on Aug. 24, 1984, by Alfred N. Johnson and Anthony J. Prisco which is entitled METHOD AND APPARATUS FOR DETECTING RADIATION IN A CONTAINER.

Thus, what has been described is a method for sorting waste which has radioactive components and to remove those components by a quick and efficient system. It results in a significant reduction in the volume of material that must be disposed of as hazardous.

Since the volume of radioactive material is substantially reduced, it can be transferred to burial sites in significantly smaller quantities and at lesser cost so that the rate at which the burial sites are filled is dramatically reduced.

While the invention has been described with respect to a particular form thereof, it is apparent that other forms should be obvious to those skilled in the art. Thus, the scope of the invention should not be limited by the foregoing, but rather, only by the scope of the claims appended hereto.

We claim:

1. A method for continuously sorting radioactive material from nonradioactive material comprising the steps of providing material containing radioactive and nonradioactive material, placing said material in a first detection station, providing means at said first detection station for detecting radiation above a first predetermined level emanating from the radioactive material and removing material which is detected as being radioactive at said first detection station, conveying the remainder of said material to a second detection station, providing means at said second detection station for detecting radiation above a second predetermined level emanating from said remainder of said material, removing material which is detected as being radioactive at said second detection station, placing the remainder of said material in a container, delivering said remaining material to a third radiation detection station, providing means at said third detection station for detecting radiation which is at a predetermined level, and storing said container if radiation is not detected at said third detector station.

2. A method as defined in claim 1 wherein the steps of conveying the remainder of said material to a second detection station comprising the steps of shredding said material to pieces of a substantially uniform size and spreading it to a substantially uniform thickness.

3. A method as defined in claim 2 wherein said second detection station includes at least one radiation detector, and said mass of material is shredded and spread before it passes into one radiation detector.

4. A method as defined in claim 3 including the steps of providing a second radiation detector, and overturning and redistributing said material after it passes said one radiation detector but before it passes said second radiation detector so that radiation on the other side of said material can be detected.

5. The method as defined in claim 1 including the step of compacting the material in said container before it is examined for radiation at said third radiation detection station.

6. The method as defined in claim 1 including the step of detecting radiation before said material is placed in said first detection station, and placing said material in said first detection station if the radiation detected is less than two milliroentgens per hour.

7. The method as defined in claim 1 wherein the sensitivity of the detectors at said third detection station is set to a predetermined level.

* * * * *